United States Patent [19]

Kreiseder

[11] Patent Number: 4,696,410

[45] Date of Patent: Sep. 29, 1987

[54] CLOSURE WITH SIDE CUT TAMPER EVIDENT FEATURE

[75] Inventor: Walter J. Kreiseder, Barrington, Ill.

[73] Assignee: Courtesy Mold & Tool Corporation, Wheeling, Ill.

[21] Appl. No.: 30,139

[22] Filed: Mar. 26, 1987

[51] Int. Cl.[4] ..... B56D 51/22

[52] U.S. Cl. ..... 220/267; 215/235; 215/257

[58] Field of Search ..... 215/235, 257; 220/267

[56] References Cited

U.S. PATENT DOCUMENTS

| | | | |
|---|---|---|---|
| 378,349 | 2/1888 | Williamson | 220/258 |
| 2,054,033 | 9/1936 | Conner et al. | 215/252 |
| 2,102,440 | 12/1937 | Sebell | 215/235 |
| 2,560,793 | 7/1951 | Greene | 215/252 |
| 3,080,991 | 3/1963 | Fox | 215/235 X |
| 3,261,504 | 7/1966 | Sabaka | 222/83 |
| 3,355,069 | 11/1967 | Miles | 222/83 |
| 3,402,855 | 9/1968 | Schroeder | 222/83 |
| 3,463,347 | 8/1969 | Kerr | 220/277 |
| 3,726,432 | 4/1973 | Gentile | 220/27 |
| 3,877,604 | 4/1975 | Brown | 220/267 |
| 3,994,413 | 11/1976 | Smyth | 222/83 |
| 4,125,203 | 11/1978 | Sovari et al. | 220/258 |
| 4,567,995 | 2/1986 | Kreiseder et al. | 220/253 |
| 4,598,837 | 7/1986 | Kreiseder et al. | 220/253 |

*Primary Examiner*—Donald F. Norton

*Attorney, Agent, or Firm*—Silverman, Cass, Singer & Winburn, Ltd.

[57] ABSTRACT

A tamper evident closure for a container having a closed endcap with an overcap to coaxially rotate thereabout. The overcap is provided with an integrally formed knife blade which is constructed and arranged to engage a weakened annular band in the container wall near the endcap. The knife blade is located within a well which is an integral part of the overcap. As the overcap is rotated, the knife blade engages and severs the annular band, and separates the closure including the endcap and the rotatable cap from the body of the container. An annular channel may also be provided to support the overcap during rotation and thus maintain the alignment of the blade with the weakened annular band.

10 Claims, 6 Drawing Figures

FIG. 1
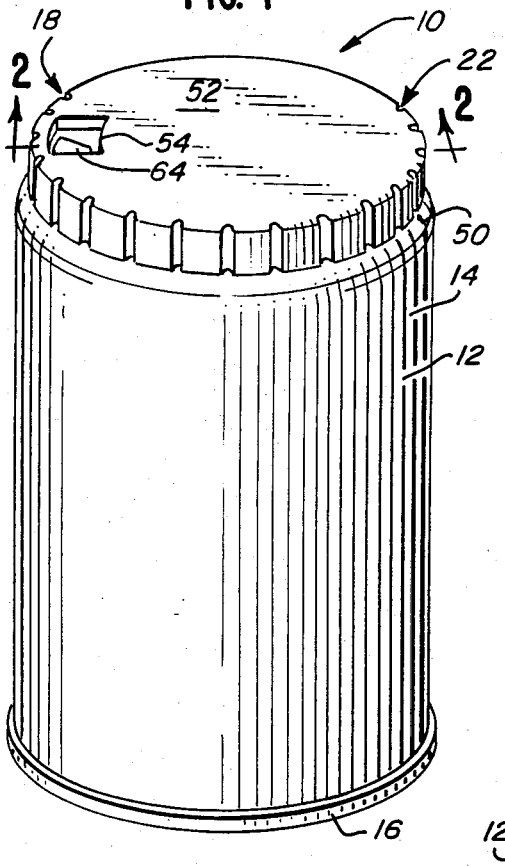
FIG. 3
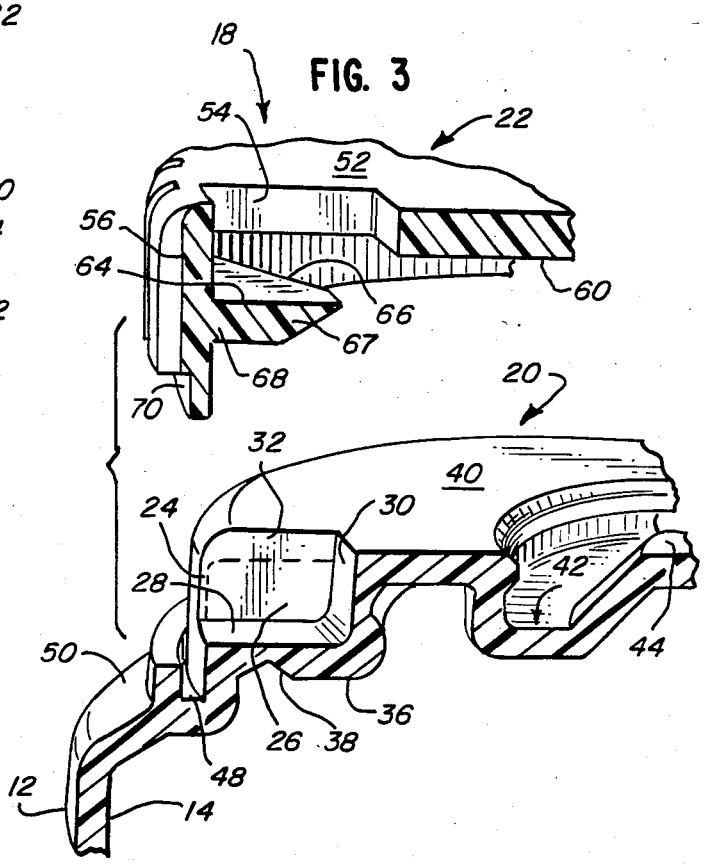
FIG. 2
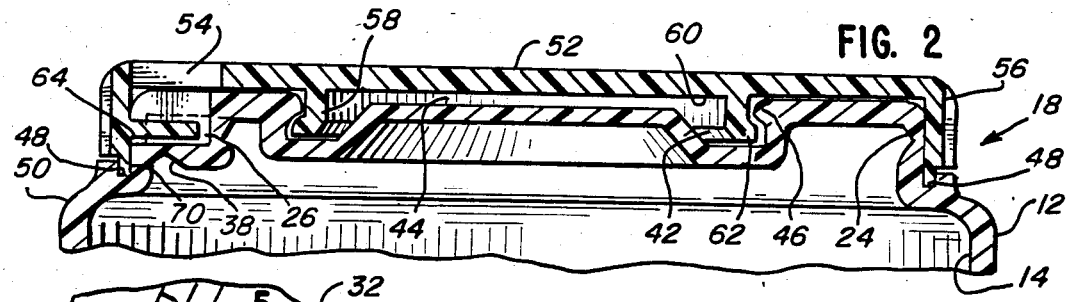
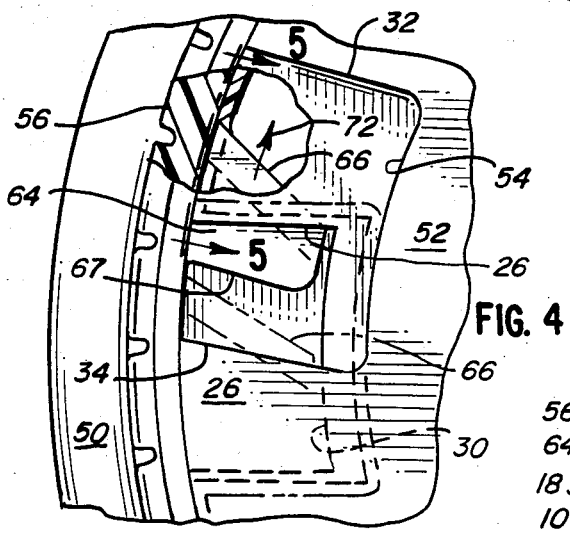
FIG. 4
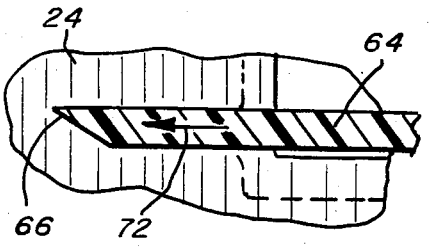
FIG. 5
FIG. 6
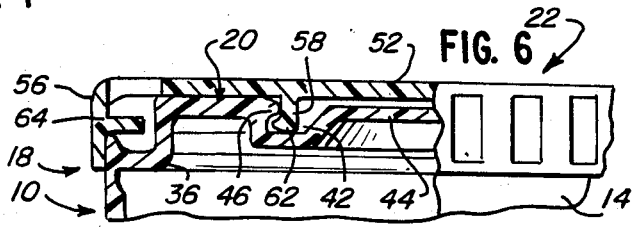

CLOSURE WITH SIDE CUT TAMPER EVIDENT FEATURE

BACKGROUND OF THE INVENTION

1. Field of the Invention

This invention relates generally to tamper evident end closures for containers, and more particularly, to an end closure for a container for retaining a comestible product.

2. Description of the Prior Art

Containers of the type with which the present invention is concerned include end closures which maintain the container in a sealed condition after packaging and provide a non-resealable top to indicate tampering with the container if the end closure is moved.

One type of previously available tamper evident container included a rotatable cap portion formed with a knife and a weakened annular portion in the end of the container. The knife requires separate manual engagement with a weakened groove in the end of the container. The cap is then rotated, causing the knife to completely sever the weakened portion of the end portion, opening the container. This conventional arrangement results in a cap which is easily detachable from the container and thus inconvenient to use. Furthermore, means are not provided for maintaining alignment of the knife blade with the weakened annular portion during movement of the knife to sever said portion. This type of construction is disclosed in U.S. Pat. No. 378,349.

It is also known to provide a sealed container with a thin member or weakened membrane functioning as the seal. A helically threaded nozzle portion having a plurality of depending knives is threaded about the outer lip of the container, so that the blades are gradually brought into contact with the thin member. As the nozzle is threaded about the throat of the container, the blades gradually pierce the membrane and open the container. This structure does not provide a hinged cap when the cutting operating is complete, but merely secures the nozzle to the container and insures communication of the contents therein with the end of the nozzle. Furthermore, once the nozzle is removed, it may be easily displaced from the container. Such a container is shown generally in U.S. Pat. No. 3,402,855.

U.S. Pat. No. 4,125,203 discloses a twist top for use with pull tab type beverage containers wherein the outer rotatable lid is attached to one end of the tab so that rotation of the lid pulls the tab away from the aperture of the container and also aligns an aperture in the lid with the aperture of the container to allow access to the beverage contained therein. This patent does not disclose the use of a rotatable outer cap with an intergral knife blade to sever an annular band in the body portion of a container and provide a hinged lid for the container.

U.S. Pat. No. 4,567,995 in the name of the same inventor as the inventor herein discloses an end closure for a container having a closed end with a cover rotatable thereabout. The closed end has a raised portion which is engaged by a knife blade integral with the cover. As the cover is rotated, the blade severs the raised portion, revealing an aperture providing access into the container. In this device, the closed end is not completely opened, nor is it hinged.

U.S. Pat. No. 4,598,837 also issued to the same inventor as the inventor herein discloses a tamper evident element in a container wherein rotation of an outer rotatable element causes an integral knife blade to sever and detach said element from the container, thus evidencing tampering when the cover is moved. This type of container is suitable for retaining food products in which small amounts are used at a time, but is not suitable for retaining food products such as frozen juices which, when the container is opened, are intended to be totally discharged from the container promptly or after a short storage period only.

Thus, it is desired to provide a temper evident container which can be used for comestibles which are intended to be discharged in bulk from the container. It also is desired to provide a tamper evident container in which the rotating overcap knife blade which opens the container by rotation of an outer cap is provided with structure to automatically engage a weakened wall portion of the container and maintain alignment of the blade with said wall portion. The closure of the present invention includes an overcap rotatably secured to the closed end of a container and is provided with an integral knife blade. Twisting the overcap relative to the container causes the knife to engage and sever the container sidewall to create a hinged lid and expose the contents for removal. Once the overcap has been rotated to any significant extent, tampering of the container is evidenced.

SUMMARY OF THE INVENTION

The invention provides a closure for a container wherein the closure is comprised of a closed endcap portion and an outer overcap portion which fits over the closed end of the container and is rotatably attached thereto. The overcap includes a knife edge formed integrally with the inner circumferential surface of a depending flange or ring thereof and built into the inside surface of the cap which to engage a weakened annular band around the wall of the container positioned proximate the endcap. Prior to opening the container, the knife blade is located within a well which is an integral part of the endcap. As the overcap is rotated, the knife blade traverses an arc beginning at one end of the well, engages and severs the weakened annular band and terminates at the other end of the well. The well is further provided with a hinged portion so that when the knife has traversed the arc around the container and has severed the endcap from the body of the container lid, the closure remains hinged to the container. The hinge prevents the closure from being completely detached from the container, and yet enables the severed closure to be moved away from the open end of the container whereby the contents may be rapidly discharged. If desired, the closure can be detached from the container by tearing the hinge. Furthermore, the closure may only be opened one time and may not be resealed, thus rendering evident any tampering of the container.

The invention may also be provided with an alignment chananel in the endcap to guide and support the overcap during rotation thereof and maintain alignment and engagement of the knife blade with the weakened annular band as the blade is moved around the band.

BRIEF DESCRIPTION OF THE DRAWING

FIG. 1 is a perspective view of a container incorporating the end closure of the invention;

FIG. 2 is a sectional view taken along the line 2—2 of FIG. 1 in the direction indicated generally;

FIG. 3 is a fragmentary exploded perspective view of the knife and well portion of the end closure shown in FIG. 2;

FIG. 4 is a top plan view of the knife and well portion thereof;

FIG. 5 is a sectional view taken along the line 5—5 of FIG. 4 in the direction indicated generally; and FIG. 6 is a fragmentary elevational view, in partial section, of the end closure portion of a container illustrating an alternate embodiment of the invention.

DESCRIPTION 0F THE PREFERRED EMBODIMENTS

Referring to FIG. 1, a container 10 is depicted having a body 12 including a wall 14. In the preferred embodiment, the body 12 is generally cylindrical in configuration, although any shape suitable for storing a desired product may be used. The container 10 is further provided with a bottom 16 at one end, constructed and arranged to be secured to the body 12 once the container 12 has been filled with product. The bottom 16 may be plastic or aluminum, and once installed, the contents of the container are hermetically sealed therein to preserve product life. Body 12 is provided, at the end opposite bottom 16, with the end closure 18 of the invention.

The end closure 18 is shown in greater detail in FIGS. 2 and 3, and is generally comprised of two main portions, these being a stationary endcap portion 20 and an overcap portion 22. The endcap 20 is integrally joined to the wall 14 of the body 12 by an annular weakened band 24. Although the endcap 20, the band 24 and the wall 14 of the invention are molded as one piece from polymeric plastic resins, any equivalent material may be used which provides a sealed end for container body 12.

Also molded into the endcap 20 is a U-shaped well 26 located in the band 24. The purpose of the well 26 will be described in detail below, it is structurally comprised of a floor 28, a vertical back wall 30, partially open first and second side walls 32, 34 (seen in FIG. 4), and an underside 36 with a weakened hinge portion 38.

The endcap 20 is further provided with a face 40 into which is molded an annular recess 42 defining a boss 44 and having an annular flange 46. An open annular channel 48 surrounds the end cap 20 and is formed integral with a shoulder 50 of the body 12.

FIGS. 2 and 3 also illustrate overcap 22, provided with a generally horizontally oriented flat lid 52, an access aperture 54, a vertically depending annular side wall or ring 56, and an annular projection 58 which depends from the underside 60 of the overcap 22. The annular projection 58 is provided with a generally outwardly facing flange 62, spaced inwardly from the underside 60.

In order to rotatably secure the overcap 22 to the endcap 20, the flange 62 of the overcap 22 is of a configuration which is generally complementary with the recessed flange 46 of the endcap 20. The internal diameter of the flange 46 is greater than the external diameter of the flange 62. Since the overcap 22 and the endcap 20 preferably are manufactured of a strong resilient plastic, such as polypropylene, there will be a snap fit interengagement between the complementary engaging faces of the flanges 46 and 62, to allow the overcap 22 to rotate about the endcap 20. The vertical wall 56 of the overcap 22 may be knurled to assist a user of the container 10 in rotating the overcap 22 about the endcap 20.

The overcap 22 is further provided with a generally horizontally disposed flattened knife blade 64 having a cutting edge 66, a truncated end 67 and a base 68. The knife blade 64 is formed integral with the vertical wall 56, being attached or secured at its base 68 thereto, and is located beneath access aperture 54 to be visible therefrom. The exact position of the blade 64 upon the wall 56 is selected to allow the edge 66 of the blade 64 to engage the weakened band 24 of the endcap portion 20. Further, the overcap 22 may be fabricated from a homopolymer material and the endcap 20 from a relatively softer co-polymer material, so that the blade 64 may more readily cut the band 24.

In the preferred embodiment, the overcap 22 has a lip 70 which vertically depends from the side wall 56 and matingly engages the open channel 48. This engagement between the lip 70 and the channel 48 is designed to enhance the alignment of the blade 64 with the weakened band 24 when the overcap 22 is subjected to the stress loads exerted by the user when the overcap is rotated during opening of the container 10.

While the container 10 is in the sealed condition, the blade 64 will be located within the U-shaped well 26, and will be clearly visible through the aperture 54. Referring now to FIGS. 4 and 5, the overcap is rotated in the direction indicated by an arrow 72. Should the overcap 22 be rotated in the opposite direction, the truncated end 67 of the knife blade 64 will impact and be stopped by the partially open side wall 34 of the well 26.

As the overcap 22 is rotated in the direction 72, the knife edge 66 will automatically engage the weakened band 24, and will sever it. Once the overcap 22 has been partially rotated, the knife blade 64 will no longer be visible through the access aperture 54, thus evidencing tampering of the container. When the overcap 22 has been completely rotated about the circumference of the container, the blade 64 will again be visible in the well 26 through the aperture 54. At this time, the closure 18, including the endcap 20 and overcap 22 will be detachable from the body 12, being held thereon only by the hinge portion 38 of the well 26. By retaining the closure 18 to the container 10 after the opening, the hinge portion 38 facilitates the use and disposal of the container. Furthermore, the severing action of the blade 64 creates a large enough opening in the container 10 to permit the contents therein to be rapidly discharged by upending the opened container. If desired, the closure 18 can be completely separated from container 10 by tearing hinge portion 38.

Referring now to FIG. 6, an alternate embodiment of the end closure 18 of the invention is shown wherein the channel 48 and the depending lip 70 have been omitted. In this embodiment, as in the preferred embodiment, the interior of the sidewall 56 rotatably engages the wall 14 of the container 10. However, in the alternate embodiment, the blade 64 receives no supplemental support to maintain its alignment with the band 24. In all other respects, the alternate embodiment of FIG. 6 is identical to the preferred embodiment of FIGS. 1–5.

Thus, the invention provides an improved, tamper evident end closure for a container. The parts are molded from plastic and are easily assembled for use. Preferably, the overcap 22 and the blade 64 are molded from a more rigid plastic material than the endcap 20 to facilitate severing of the weakend band 24. The endcap portion 22 is closed and thus provides for hermetic sealing of the container after packaging. By rotating the overcap 22, the blade 64 severs the band 24, allowing the overcap 22 and the endcap 20 to be detached from the container body 12. The hinge 38 of well 26 secures the closure 18 to the body 12, unless torn by the user.

While preferred embodiments of the invention have been shown, it will be understood that the invention may be otherwise embodied within the scope of the attached claims. Minor variations in the structure and in the arrangement and size of the various parts may occur to those skilled in the art without departing from the spirit and scope of the invention.

I claim:

1. A tamper evident end closure for a container comprising:

a stationary endcap portion integrally joined to and forming a closed end of said container by means of a weakened annular band and an integral well having first and second ends and a hinged portion, said well being located on said endcap portion and in said annular band;

an overcap portion attached to and covering said endcap portion and being coaxially rotatable thereabout; and a knife blade secured to said overcap portion and arranged to engage and circumscribe said annular band as said overcap portion is rotated about said endcap portion, severing said endcap from said first end of said well to said second end of said well, forming a hinged lid for said container.

2. The closure defined in claim 1 wherein said knife blade is located within said well prior to the rotation of said overcap portion about said endcap portion.

3. The closure defined in claim 1 wherein said overcap portion and said endcap portion are provided with means for maintaining engagement of said blade with said band.

4. The closure defined in claim 3 wherein said means for maintaining engagement include a depending annular lip on said overcap which engages an annular channel in said endcap portion.

5. The closure defined in claim 1 wherein said overcap is provided with an aperture which overlays and provides visual access to said blade.

6. The closure defined in claim 1 wherein said hinge may be torn, allowing the total separation of said closure from said container.

7. A tamper evident container closure comprising:

a container body with an interior, a wall with a thickness, a closed endcap with an exterior face, an annular undercut portion therein, and an annular channel;

an annular band integrally joining said wall to said endcap, said band having two ends and designating a reduction in said thickness of said wall;

a U-shaped well in said closed end located between said ends of said band and having a first end, a second end and a hinged portion;

an overcap constructed and arranged to cover said endcap, said overcap provided with a lid portion with an underside, an engaging member depending from said underside, an annular sidewell depending vertically from said lid, engaging said well of said body and further having an annular lip depending from said sidewell to engage said channel, said engaging member engaging said undercut of said endcap to permit coaxial rotation of said overcap about said body;

a knife blade secured to said interior of said ring located within said well, and constructed and arranged to engage said band of said wall as said overcap rotates about said body from said first end of said well to said second end of said well, and to thereby sever and to substantially detach and hinge said closure to said body to permit access to said interior.

8. The closure defined in claim 7 wherein said overcap is provided with an access aperture.

9. The closure defined in claim 8 wherein said access aperture is positioned directly above said knife.

10. A tamper evident container closure comprising;

a container body with an interior, a wall with a thickness, a closed endcap with an exterior face, an annular undercut portion therein, and an annular channel;

an annular band integrally joining said wall to said endcap, said band having two ends and designating a reduction in said thickness of said wall;

a U-shaped well in said closed end located between said ends of said band and having a first end, a second end and a hinged portion;

an overcap constructed and arranged to cover the closed end of said body, said overcap provided with a lid portion with an underside, an engaging member depending from said underside, an annular sidewall depending vertically from said lid, engaging said wall of said body and further having an annular lip depending from said sidewall to engage said channel, said engaging member engaging said undercut of said endcap to permit coaxial rotation of said overcap about said body;

a knife blade secured to said interior of said ring located within said well, and constructed and arranged to engage said band of said wall as said overcap rotates about said body from said first end of said well to said second end and to thereby sever and to substantially detach and hinge the closure from said body to permit access to said interior of said body; and said overcap is provided with an access aperture positioned directly above said knife.

* * * * *